US010095180B2

(12) United States Patent
Harada et al.

(10) Patent No.: US 10,095,180 B2
(45) Date of Patent: Oct. 9, 2018

(54) DEVELOPING CARTRIDGE WHICH IS MOVABLE TOWARD AND AWAY FROM IMAGE BEARING MEMBER

(71) Applicant: CANON KABUSHIKI KAISHA, Tokyo (JP)

(72) Inventors: Tatsuro Harada, Mishima (JP); Daisuke Makiguchi, Izunokuni (JP); Masato Tanabe, Susono (JP); Hiroki Shimizu, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/441,420

(22) Filed: Feb. 24, 2017

(65) Prior Publication Data

US 2017/0261917 A1 Sep. 14, 2017

(30) Foreign Application Priority Data

Mar. 11, 2016 (JP) ..... 2016-048678

(51) Int. Cl.
*G03G 21/00* (2006.01)
*G03G 21/16* (2006.01)
*G03G 21/18* (2006.01)

(52) U.S. Cl.
CPC ..... *G03G 21/1647* (2013.01); *G03G 21/1676* (2013.01); *G03G 21/1821* (2013.01); *G03G 2221/163* (2013.01)

(58) Field of Classification Search
CPC ..... G03G 21/1647; G03G 21/1676; G03G 21/1825; G03G 21/1821; G03G 2221/163; G03G 2221/1815
USPC ..... 399/119
See application file for complete search history.

(56) References Cited

U.S. PATENT DOCUMENTS

| | | | |
|---|---|---|---|
| 7,680,436 | B2 | 3/2010 | Hayakawa |
| 7,715,746 | B2 | 5/2010 | Tanabe et al. |
| 7,813,671 | B2 | 10/2010 | Nittani et al. |
| 7,894,733 | B2 | 2/2011 | Tanabe et al. |
| 7,953,340 | B2 | 5/2011 | Tanabe et al. |
| 7,957,671 | B2 | 6/2011 | Hayakawa |
| 8,099,018 | B2 | 1/2012 | Takakuwa et al. |
| 8,190,059 | B2 | 5/2012 | Hayakawa |

(Continued)

FOREIGN PATENT DOCUMENTS

| | | | |
|---|---|---|---|
| JP | 03267962 | A * | 11/1991 |
| JP | 05232789 | A * | 9/1993 |

(Continued)

*Primary Examiner* — Robert Beatty
(74) *Attorney, Agent, or Firm* — Fitzpatrick, Cella, Harper & Scinto

(57) ABSTRACT

Disclosed is a developing cartridge in which a developer bearing member moves when a pressed part is pressed by a press member provided in a main body of an apparatus to move a developing frame in a state in which the developing cartridge is attached to the main body of the apparatus. The pressed part is provided with a positioning part that contacts and positions the press member. The press member is urged toward the positioning part by an urging member. The developing frame has a guiding part that moves the press member against an urging force of the urging member when the developing cartridge is attached to the main body of the apparatus.

11 Claims, 17 Drawing Sheets

(56) References Cited

U.S. PATENT DOCUMENTS

| | | | | |
|---|---|---|---|---|
| 8,238,787 | B2 * | 8/2012 | Tani | G03G 21/1825 399/111 |
| 8,301,054 | B2 | 10/2012 | Tanabe et al. | |
| 8,396,392 | B2 | 3/2013 | Takakuwa et al. | |
| 8,428,491 | B2 * | 4/2013 | Yamamoto | G03G 15/0896 399/119 |
| 8,781,360 | B2 | 7/2014 | Takakuwa et al. | |
| 8,818,235 | B2 | 8/2014 | Kishi | |
| 9,037,037 | B2 | 5/2015 | Takakuwa et al. | |
| 9,052,638 | B2 | 6/2015 | Matsumaru et al. | |
| 9,069,289 | B2 | 6/2015 | Batori et al. | |
| 9,116,466 | B2 | 8/2015 | Makiguchi et al. | |
| 9,164,424 | B2 | 10/2015 | Nakamura et al. | |
| 9,164,430 | B2 | 10/2015 | Murakami et al. | |
| 9,188,906 | B2 | 11/2015 | Batori et al. | |
| 9,229,371 | B2 | 1/2016 | Murakami et al. | |
| 9,465,318 | B2 | 10/2016 | Takeuchi et al. | |
| 9,494,890 | B2 | 11/2016 | Komatsu et al. | |
| 9,523,942 | B2 | 12/2016 | Takeuchi et al. | |
| 9,599,932 | B2 | 3/2017 | Takeuchi et al. | |
| 9,599,956 | B2 | 3/2017 | Kawanami | |
| 2007/0077086 | A1 | 4/2007 | Takakuwa et al. | |
| 2007/0147890 | A1 | 6/2007 | Hayakawa | |
| 2009/0297215 | A1 * | 12/2009 | Munetsugu | G03G 21/1825 399/111 |
| 2012/0269547 | A1 | 10/2012 | Kishi | |
| 2013/0223853 | A1 | 8/2013 | Chadani et al. | |
| 2013/0315621 | A1 * | 11/2013 | Toriyama | G03G 21/1853 399/111 |
| 2014/0169829 | A1 | 6/2014 | Maeshima et al. | |
| 2015/0248106 | A1 | 9/2015 | Takakuwa et al. | |
| 2015/0277370 | A1 | 10/2015 | Maeshima et al. | |
| 2015/0301497 | A1 | 10/2015 | Kawanami | |
| 2016/0018784 | A1 | 1/2016 | Maeshima et al. | |
| 2017/0060033 | A1 | 3/2017 | Takeuchi et al. | |
| 2017/0082971 | A1 | 3/2017 | Maeshima et al. | |
| 2017/0205763 | A1 * | 7/2017 | Sato | G03G 21/1676 |
| 2017/0248905 | A1 * | 8/2017 | Anan | G03G 21/1647 |
| 2017/0248906 | A1 * | 8/2017 | Tanabe | G03G 21/1647 |
| 2017/0248909 | A1 * | 8/2017 | Nakamura | G03G 21/1647 |
| 2017/0261918 | A1 * | 9/2017 | Zensai | G03G 21/1647 |
| 2017/0261920 | A1 * | 9/2017 | Kawamura | G03G 21/1647 |
| 2017/0261921 | A1 * | 9/2017 | Kawamura | G03G 21/1647 |
| 2017/0315498 | A1 * | 11/2017 | Abe | G03G 21/1647 |

FOREIGN PATENT DOCUMENTS

| | | | |
|---|---|---|---|
| JP | 2007101637 | A | 4/2007 |
| JP | 2007-178482 | A | 7/2007 |
| JP | 2011-039564 | A | 2/2011 |
| JP | 2012-226278 | A | 11/2012 |
| JP | 2012-230417 | A | 11/2012 |
| JP | 2015-206897 | A | 11/2015 |

* cited by examiner 144
104
43C
125
2
Y1
131
144A
144
50
126
144
SEPARATING STATE
CONTACTING STATE SEPARATING STATE
CONTACTING STATE
53
54
Q1
50
W1
50E
50B
144A
51
V1
52
50D
51A
50A
33

54
R1
53C
SEPARATING STATE
CONTACTING STATE 2
125
126
Y2
43C
104
131
144A
50
CONTACTING STATE
SEPARATING STATE 54
53
Q2
52
50D
51A
50A
V2
50
W2
50E
50B
144A
51
33
CONTACTING STATE
SEPARATING STATE

54
R1
54A
53C
CONTACTING STATE
SEPARATING STATE

DEVELOPING CARTRIDGE WHICH IS MOVABLE TOWARD AND AWAY FROM IMAGE BEARING MEMBER

BACKGROUND OF THE INVENTION

Field of the Invention

The present invention relates to a developing cartridge attachable/detachable to/from a main body of an image forming apparatus, and an image forming apparatus that forms an image on a recording medium using an electrophotographic technology.

Description of the Related Art

In an image forming apparatus such as a printer using an electrophotographic technology, a photosensitive drum is first uniformly charged by a charging roller to form an image on a sheet such as a recording sheet. Next, the charged photosensitive drum is selectively exposed by an exposing apparatus to form an electrostatic latent image on the photosensitive drum. Further, the electrostatic latent image formed on the photosensitive drum is developed by a developing apparatus to form a toner image on the photosensitive drum. The toner image formed on the photosensitive drum is transferred onto a sheet. After that, the toner image transferred onto the sheet is heated and pressed to be fixed onto the sheet. Thus, an image is formed on the sheet. In addition, residual toner on the photosensitive drum after the toner image has been transferred onto the sheet is removed by a cleaning blade.

In such an image forming apparatus, it is generally necessary to perform the maintenance of processing means such as a photosensitive drum and a developing apparatus. Therefore, in recent years, a photosensitive drum, a charging roller, a developing apparatus, a cleaning blade, etc., are often integrated as a cartridge in order to facilitate the maintenance of processing means. Such a cartridge is called a process cartridge and attachable/detachable to/from a main body of an image forming apparatus. By employing such a process cartridge system, a user is allowed to facilitate the maintenance of processing means to form an image on a sheet. Here, a process cartridge has generally a drum unit provided with a photosensitive drum and a developing unit provided with a developing apparatus.

Here, in a technology disclosed in Japanese Patent Application Laid-open No. 2011-039564, a developing unit is attachable/detachable to/from a main body of an image forming apparatus as a developing cartridge. In addition, in the technology disclosed in Japanese Patent Application Laid-open No. 2011-039564, the main body of the image forming apparatus is provided with an opening/closing door, and exposed to an outside when the opening/closing door is opened. Further, the developing cartridge may be attached to the main body of the apparatus in a state in which the opening/closing door is opened. Here, in the technology disclosed in Japanese Patent Application Laid-open No. 2011-039564, the opening/closing door is provided with a spring member. Further, when the opening/closing door is closed in a state in which the developing cartridge is attached to the main body of the apparatus, the spring member provided on the opening/closing door presses the developing cartridge. Therefore, when the developing cartridge is pressed toward the photosensitive drum, a developing roller provided in the developing cartridge is pressed onto the photosensitive drum. Thus, the developing roller is positioned with respect to the main body of the image forming apparatus.

SUMMARY OF THE INVENTION

Here, there has been conventionally known a configuration in which a developing cartridge rotates in a state of being attached to a main body of an apparatus, whereby a developing roller is capable of coming in contact with and separating from a photosensitive drum. Further, the developing cartridge rotates when being pressed by a press member provided in the main body of the apparatus.

Here, in order to fix the pressure force of the developing roller with respect to the photosensitive drum and the interval (separation amount) between the developing roller and the photosensitive drum, the press member is preferably positioned with respect to the developing cartridge when pressing the developing cartridge. To this end, there has been expected a virtual technology in which the press member is urged by a spring toward the developing cartridge in a state in which the developing cartridge is attached to the main body of the apparatus. In this case, the press member is positioned with respect to the developing cartridge when abutting on the developing cartridge.

In such a virtual technology, however, since the press member is urged by the spring even after the developing cartridge is detached from the main body of the apparatus, a part of the press member may enter a region where the developing cartridge passes through.

In this case, the developing cartridge may get snagged on the press member when being inserted in the main body of the apparatus, which results in a difficulty in attaching the developing cartridge to the main body of the apparatus.

The present invention has an object of facilitating the attachment of a developing cartridge to a main body of an apparatus.

In addition, the present invention has another object of providing the following developing cartridge.

The present invention provides a developing cartridge attachable/detachable to/from a main body of an image forming apparatus, the developing cartridge including: a developer bearing member that bears a developer to form a developer image on an image bearing member provided in the main body of the apparatus; a developing frame that supports the developer bearing member; and a pressed part that is provided on the developing frame, the developer bearing member being configured to move when the pressed part is pressed by a press member, provided in the main body of the apparatus, to move the developing frame in a state in which the developing cartridge is attached to the main body of the apparatus, wherein the pressed part is provided with a positioning part that contacts and positions the press member, the press member is urged toward the positioning part by an urging member, and the developing frame has a guiding part that moves the press member against an urging force of the urging member when the developing cartridge is attached to the main body of the apparatus.

Further features of the present invention will become apparent from the following description of exemplary embodiments (with reference to the attached drawings).

DESCRIPTION OF THE EMBODIMENTS

Hereinafter, a description will be given of an embodiment of the present invention with reference to the drawings. However, dimensions, materials, shapes, their relative arrangements, or the like of constituents described in the embodiment may be appropriately changed according to configurations, various conditions, or the like of apparatuses to which the invention is applied, and do not intend to limit the scope of the invention to the following embodiment.

Embodiment (Entire Configuration of Image Forming Apparatus)

Figure 2:
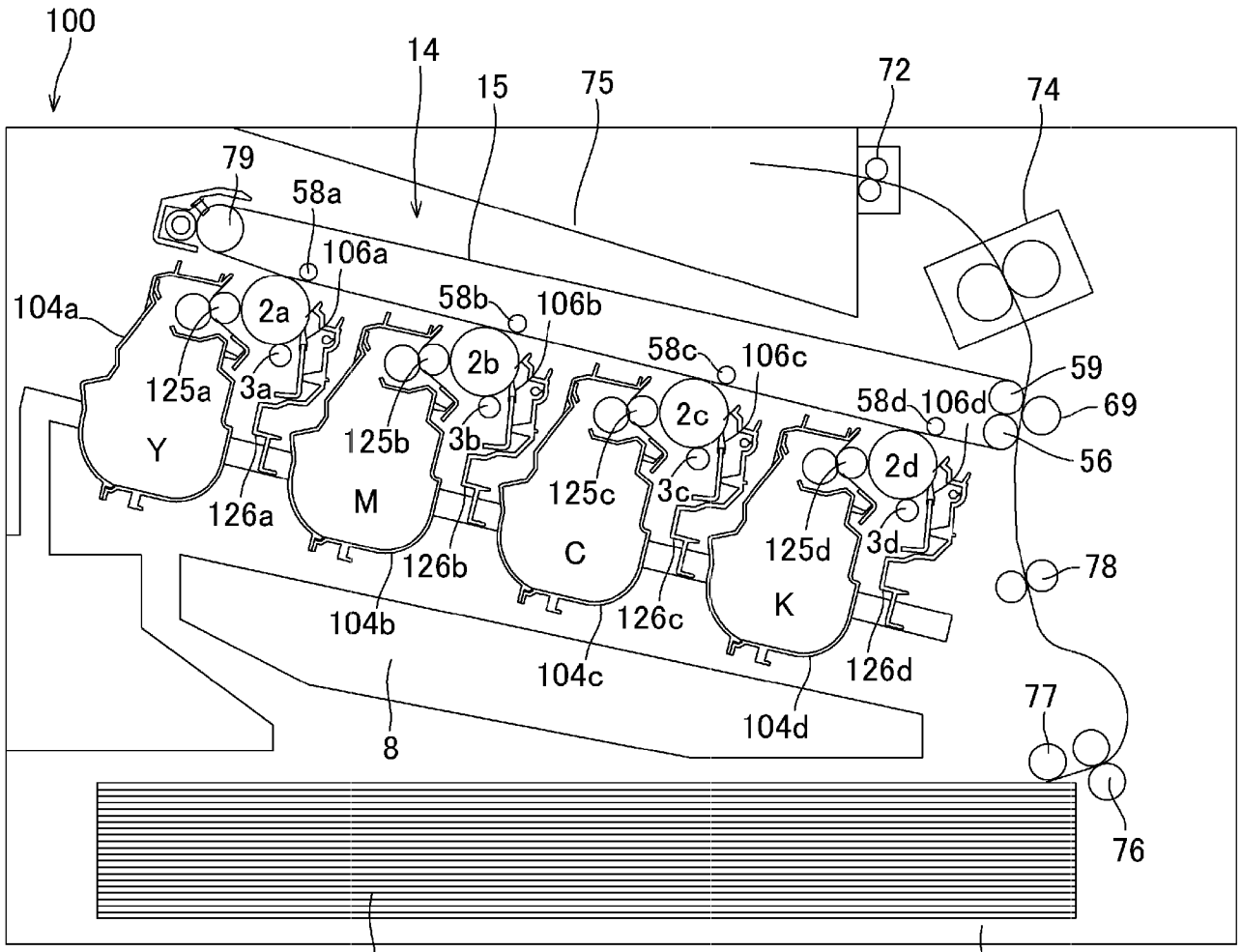
FIG. 2 is a schematic cross-sectional view of an image forming apparatus according to the embodiment.

Hereinafter, the embodiment will be described based on the drawings. First, a description will be given, with reference to FIG. 2, of the entire configuration of an electrophotographic image forming apparatus 100 (hereinafter called an image forming apparatus 100). As shown in FIG. 2, four drum cartridges 126 (126*a*, 126*b*, 126*c*, and 126*d*) and four developing cartridges 104 (104*a*, 104*b*, 104*c*, and 104*d*) are attached to the image forming apparatus 100 by attachment members (not shown). Here, an upstream side and a downstream side in a direction in which the drum cartridges 126 and the developing cartridges 104 are inserted in the main body of the image forming apparatus 100 will be defined as a front face side and a back face side, respectively. In FIG. 2, the drum cartridges 126 and the developing cartridges 104 are arranged side by side in the main body of the image forming apparatus 100 so as to be inclined with respect to a horizontal direction.

The respective drum cartridges 126 (126*a* to 126*d*) have photosensitive drums 2 (hereinafter called photosensitive drums 2) (2*a*, 2*b*, 2*c*, and 2*d*) serving as image bearing members and charging rollers 3 (3*a*, 3*b*, 3*c*, and 3*d*) provided around the photosensitive drums 2. In addition, the drum cartridges 126 have cleaning members 106 (106*a*, 106*b*, 106*c*, and 106*d*). Processing means such as the photosensitive drums 2, the charging rollers 3, and the cleaning members 106 is integrated as drum cartridges 126. In addition, in the respective developing cartridges 104 (104*a* to 104*d*), processing means such as developing rollers 125 (125*a* to 125*d*) serving as developer bearing members and developing blades 135 (135*a* to 135*d*) (see FIG. 4) is integrally arranged.

Here, the charging rollers 3 uniformly charge the surfaces of the photosensitive drums 2 serving as image bearing members, and the developing rollers 125 serving as developer bearing members develop electrostatic latent images formed on the photosensitive drums 2 with a developer (hereinafter called toner). Further, the cleaning members 106 remove residual toner on the photosensitive drums 2 after toner images representing developer images formed on the photosensitive drums 2 have been transferred onto a recording medium S. In addition, under the drum cartridges 126 and the developing cartridges 104, a scanner unit 8 is provided that selectively exposes the photosensitive drums 2 based on image information to form electrostatic latent images on the photosensitive drums 2.

At the lower part of the image forming apparatus 100, a cassette 17 that accommodates recording medium S is attached. In addition, in the image forming apparatus 100, recording medium transport means for transporting the recording medium S to the upper part of the image forming apparatus 100 via a secondary transfer roller 69 and a fixing unit 74 is provided. Specifically, the recording medium transport means has a feed roller 77 that separates and feeds the recording medium S inside the cassette 17 one by one and a transport roller 76 that transports the fed recording medium S. In addition, the recording medium transport means has a resist roller 78 that synchronizes toner images formed on the photosensitive drums 2 with the recording medium S.

In addition, over the drum cartridges 126 (126*a*, 126*b*, 126*c*, and 126*d*), an intermediate transfer unit 14 serving as intermediate transfer means for transferring toner images formed on the respective photosensitive drums 2 (2*a*, 2*b*, 2*c*, and 2*d*) onto the recording medium S is provided. The intermediate transfer unit 14 has a drive roller 56, a driven roller 79, and primary transfer rollers 58 (58*a*, 58*b*, 58*c*, and 58*d*) provided at positions facing the photosensitive drums 2 of respective colors. In addition, the intermediate transfer unit 14 has a facing roller 59 provided at a position facing the secondary transfer roller 69 and a transfer belt 15. The transfer belt 15 is stretched over between the drive roller 56, the driven roller 79, the primary transfer roller 58, and the facing roller 59.

The transfer belt 15 circularly moves so as to face and contact all the photosensitive drums 2. Further, toner images on the photosensitive drums 2 are primarily transferred onto the transfer belt 15 when a voltage is applied to the primary transfer rollers 58 (58*a*, 58*b*, 58*c*, and 58*d*). Further, the toner images on the transfer belt 15 are secondarily transferred onto the recording medium S when a voltage is applied to the facing roller 59 arranged inside the transfer belt 15 and the secondary transfer roller 69.

When an image is formed on the recording medium S, the rotating photosensitive drums 2 are uniformly charged by the charging rollers 3. Further, when the photosensitive drums 2 are selectively exposed by the scanner unit 8, electrostatic latent images are formed on the photosensitive drums 2. The electrostatic latent images formed on the photosensitive drums 2 are developed as toner images by toner attached onto the developing rollers 125. Thus, toner images of the respective colors are formed on the respective photosensitive drums 2.

In addition, with the operation of forming the toner images on the photosensitive drums 2, the resist roller 78 transports the recording medium S to a secondary transfer position at which the facing roller 59 and the secondary transfer roller 69 come in contact with each other via the transfer belt 15. Further, when a transfer bias voltage is applied to the secondary transfer roller 69, the toner images of the respective colors on the transfer belt 15 are secondarily transferred onto the recording medium S. Then, the recording medium S onto which the toner images have been secondarily transferred is heated and pressed by the fixing unit 74 to fix the toner images onto the recording medium S. After that, the recording medium S onto which the toner images have been fixed is discharged to a discharge unit 75 by a discharge roller 72. Note that the fixing unit 74 is arranged at the upper part of the main body of the image forming apparatus 100.

(Configuration of Drum Cartridges)

Figure 3:
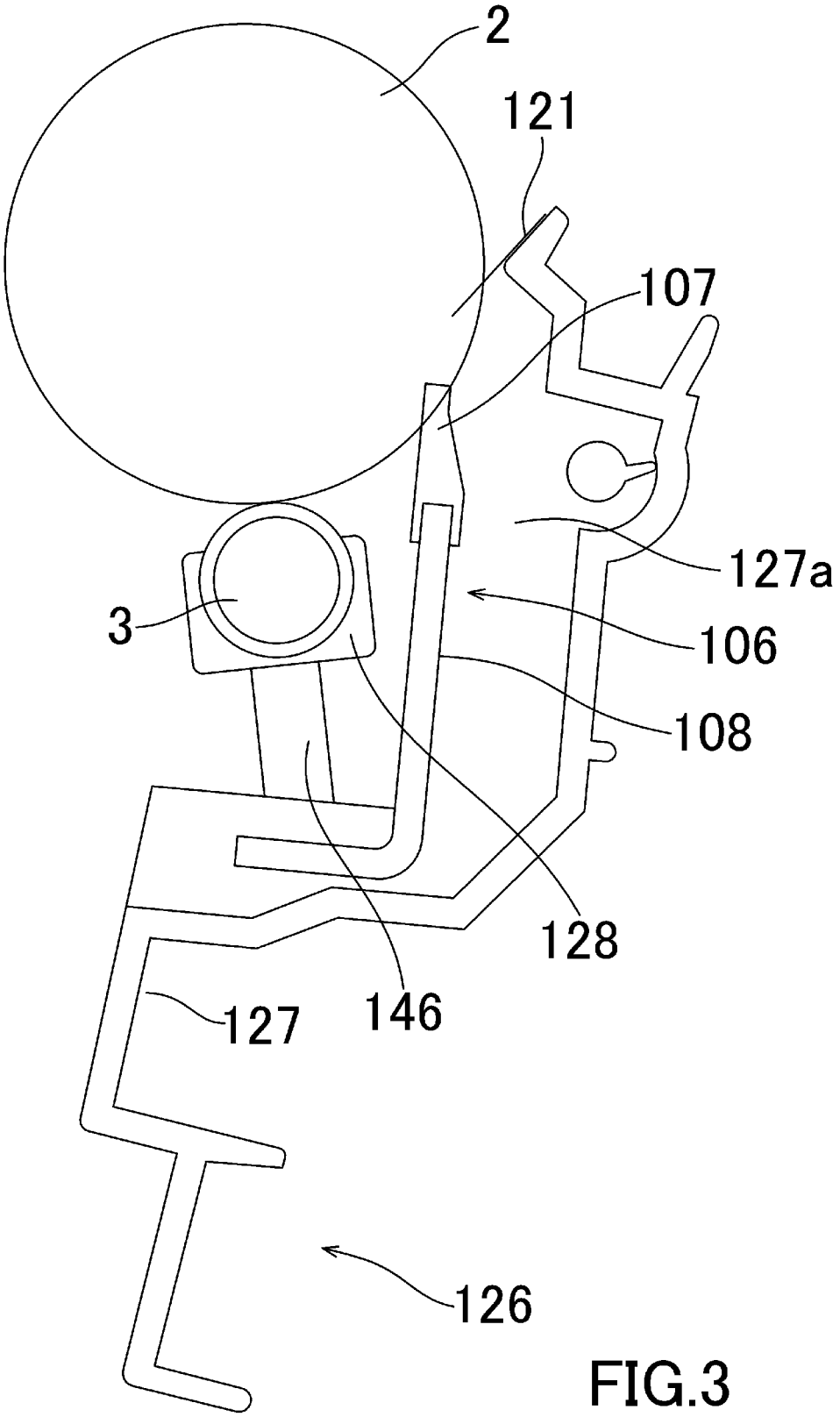
FIG. 3 is a schematic cross-sectional view of a drum cartridge according to the embodiment.

Next, a description will be given, with reference to FIG. 3, of the drum cartridges 126 according to the embodiment. FIG. 3 is a schematic cross-sectional view of the drum cartridges 126 according to the embodiment. Note that the drum cartridges 126*a* to 126*d* have the same configuration in the embodiment. In each of the drum cartridge 126 (126*a*, 126*b*, 126*c*, and 126*d*), the photosensitive drum 2 is rotatably supported by a cleaning frame 127. In addition, on one end side in the rotation center axis direction of the photosensitive drum 2, a drum coupling (not shown) and a flange (not shown) are provided.

As described above, the charging roller 3 and the cleaning member 106 are provided around the photosensitive drum 2 serving as an image bearing member. The cleaning member 106 is constituted by a rubber blade 107 formed of an elastic member and a cleaning support member 108. In addition, the tip end of the rubber blade 107 comes in contact with the photosensitive drum 2 in a direction countering the rotational direction of the photosensitive drum 2. Further, residual toner removed from the surface of the photosensitive drum 2 by the cleaning member 106 drops into a removed toner chamber 127*a*. In addition, a squeegee sheet 121 that prevents the leakage of residual toner inside the removed toner chamber 127*a* comes in contact with the photosensitive drum 2.

Here, when a drive force is transmitted from a main body drive motor (not shown) serving as a drive source to the drum cartridge 126, the photosensitive drum 2 rotates and drives according to an image forming operation. In addition, the charging roller 3 is rotatably attached to the drum cartridge 126 via a charging roller bearing 128. Further, the charging roller 3 rotates so as to follow the photosensitive drum 2 while being pressed toward the photosensitive drum 2 by a charging roller pressure member 146.

(Configuration of Developing Cartridges)

Figure 4:
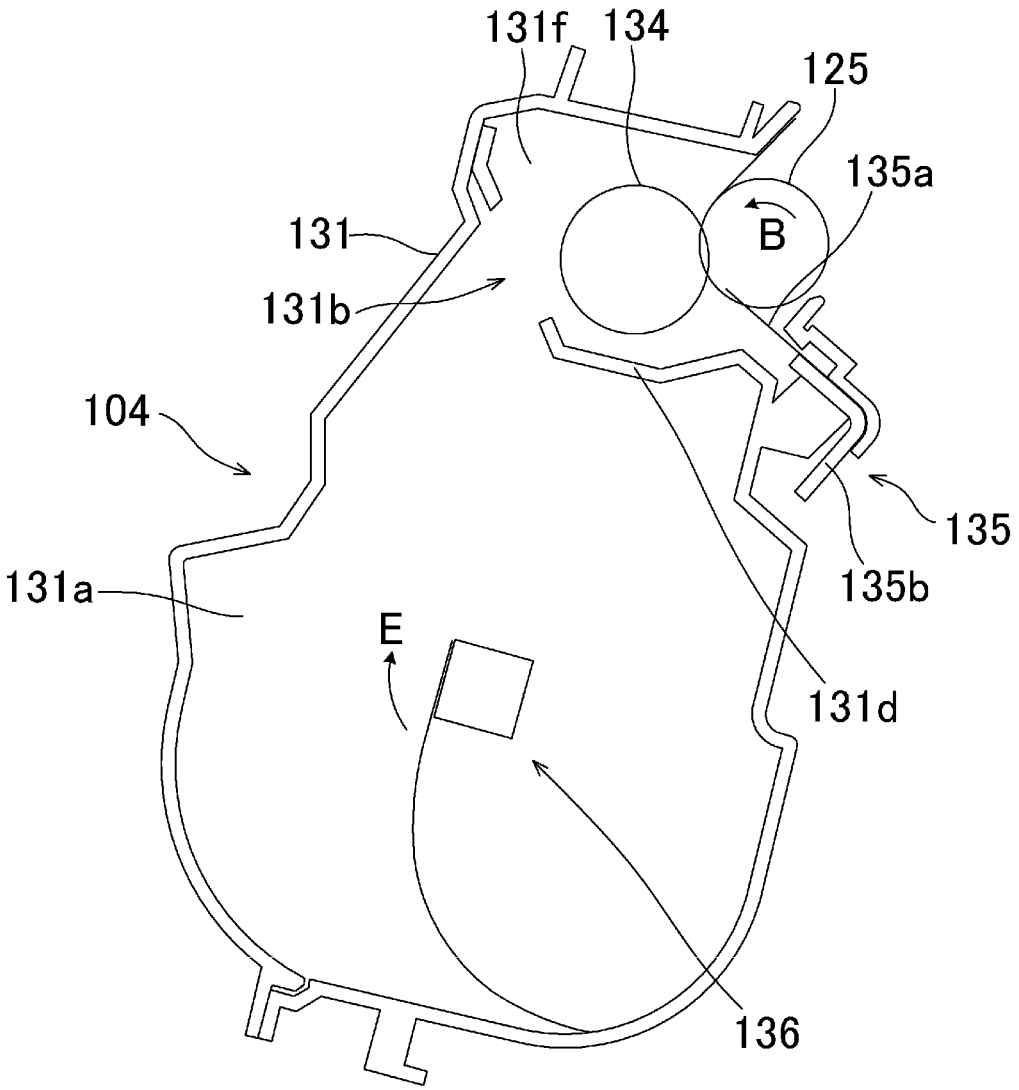
FIG. 4 is a schematic cross-sectional view of the developing cartridge according to the embodiment.

Next, a description will be given, with reference to FIG. 4, of the developing cartridges 104. FIG. 4 is a schematic cross-sectional view of the developing cartridges 104 according to the embodiment. In the embodiment, the image forming apparatus 100 has a developing cartridge 104*a* in which the toner of yellow is accommodated and a developing cartridge 104*b* in which the toner of magenta is accommodated. In addition, the image forming apparatus 100 has a developing cartridge 104*c* in which the toner of cyan is accommodated and a developing cartridge 104*d* in which the toner of black is accommodated. Here, the developing cartridges 104*a* to 104*d* have the same configuration.

The developing cartridge 104 has a developing roller 125 that rotates in a B direction indicated by an arrow while contacting the photosensitive drum 2 serving as an image bearing member. In addition, the developing cartridge 104 has a toner supply roller 134 that rotates while contacting the developing roller 125, and a developing blade 135 (a control part is denoted by numeral 135*a* and a support part is denoted by numeral 135*b*) that controls a layer thickness of toner on the developing roller 125. In addition, the developing cartridge 104 has a toner transport member 136 that rotates in an E direction indicated by an arrow and a developing frame 131 (second support member) that supports the developing roller 125, the toner supply roller 134, the developing blade 135, and the toner transport member 136.

The developing frame 131 serving as a second support member is constituted by a developing chamber 131*f* in which the developing roller 125 serving as a developer bearing member is arranged, and a toner accommodation chamber 131*a* provided beneath the developing chamber 131*f*. The developing chamber 131*f* and the toner accommodation chamber 131*a* are partitioned by a partition wall 131*d*. In addition, the partition wall 131*d* is provided with an opening part 131*b* for allowing the toner to pass through so that the toner is transported from the toner accommodation chamber 131*a* to the developing chamber 131*f*.

The developing roller 125 serving as a developer bearing member and the toner supply roller 134 are rotatably supported by the developing frame 131 via a front side bearing (not shown) and a back side bearing (not shown) provided on both sides in the rotation center axis direction of the developing roller 125. In addition, the toner transport member 136 is provided in the toner accommodation chamber 131*a*, and transports the toner to the developing chamber 131*f* via the opening part 131*b* while stirring the toner accommodated in the toner accommodation chamber 131*a*.

(Configuration of Attaching/Detaching Drum Cartridges 126 and Developing Cartridges 104)

Figure 5:
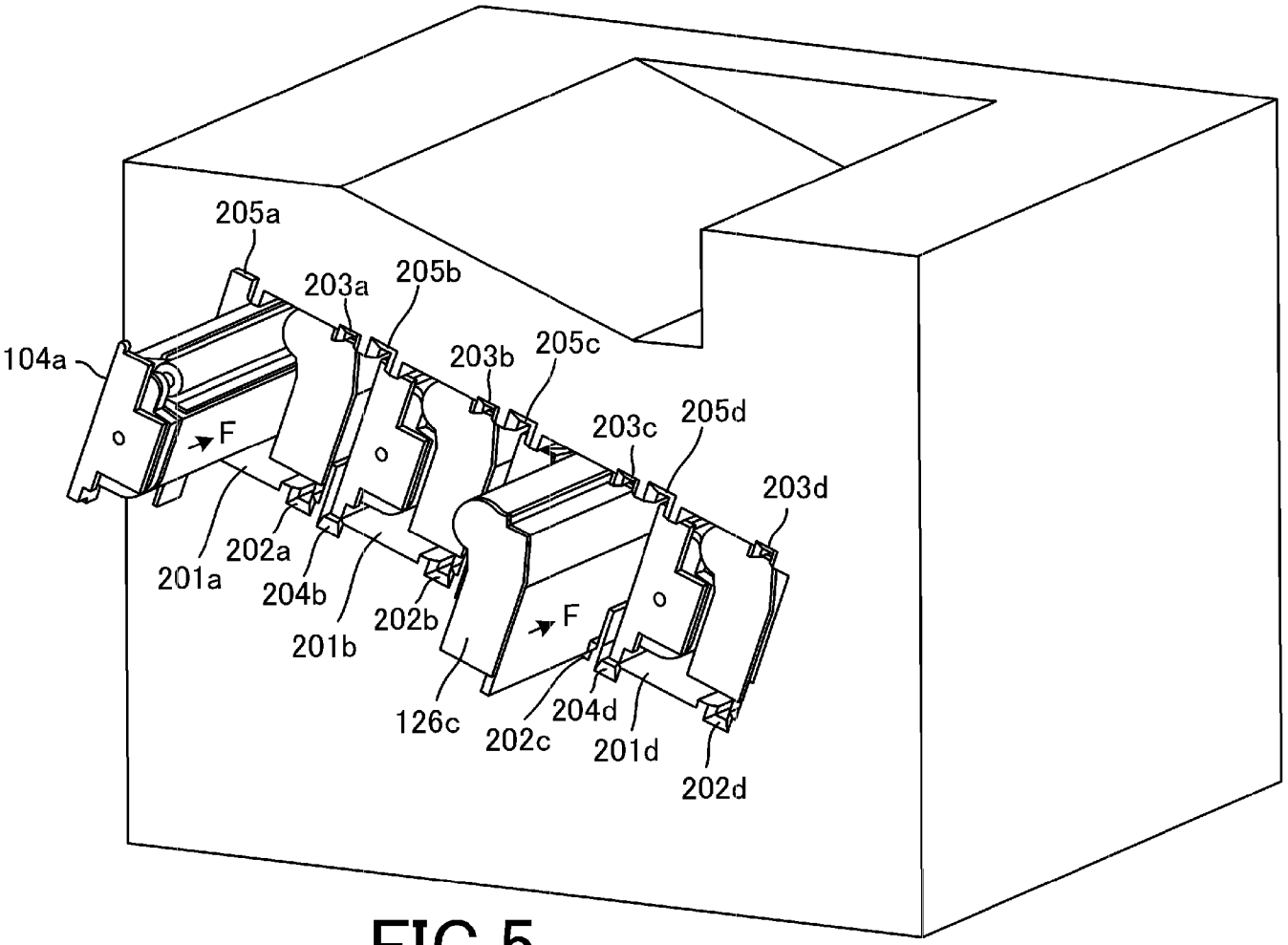
FIG. 5 is a view showing a state in which the developing cartridges and drum cartridges are attached.

Next, a description will be given, with reference to FIG. 5, of the configuration of attaching/detaching the drum cartridges 126 and the developing cartridges 104 to/from the image forming apparatus 100. Note that in the embodiment, the drum cartridges 126 and the developing cartridges 104 are inserted in opening parts 201 (201*a* to 201*d*) from a near side to a back side in a direction (F direction indicated by an arrow in FIG. 5) substantially parallel to the rotation center axis direction of the developing rollers 125 and the photosensitive drums 2. In the embodiment, the upstream side and the downstream side in the direction in which the drum cartridges 126 and the developing cartridges 104 are inserted will be defined as the near side and the back side, respectively.

On the upper side of the opening parts 201 of the image forming apparatus 100, upper guide parts 203 (203*a*, 203*b*, 203*c*, and 203*d*) are provided. In addition, on the lower side of the opening parts 201, lower guide parts 202 (202*a*, 202*b*, 202*c*, and 202*d*) are provided. Each of the upper guide parts 203 and the lower guide parts 202 has a shape extending along the direction (F direction indicated by an arrow) in which the drum cartridges 126 are inserted. Further, in a state of being fitted with the lower guide parts 202 on the near side, the drum cartridges 126 are moved in the F direction along the upper guide parts 203 and the lower guide parts 202. In the manner described above, the drum cartridges 126 are inserted in the image forming apparatus 100.

The developing cartridges 104 are inserted in the image forming apparatus 100 in the same manner as when the drum cartridges 126 are inserted in the image forming apparatus 100. On the upper side of the opening parts 201 of the image forming apparatus 100, upper guide parts 205 (205*a*, 205*b*, 205*c*, and 205*d*) are provided. In addition, on the lower side of the opening parts 201, lower guide parts 204 (204*a*, 204*b*, 204*c*, and 204*d*) are provided. First, the developing cartridges 104 are fitted with the lower guide parts 204 on the near side. Further, the developing cartridges 104 are moved in the F direction along the upper guide parts 205 and the lower guide parts 204. In the manner described above, the developing cartridges 104 are inserted in the image forming apparatus 100.

(Mechanism to Cause Photosensitive Drum 2 and Developing Roller 125 to Come in Contact with Each Other and Separate from Each Other)

Figure 6:
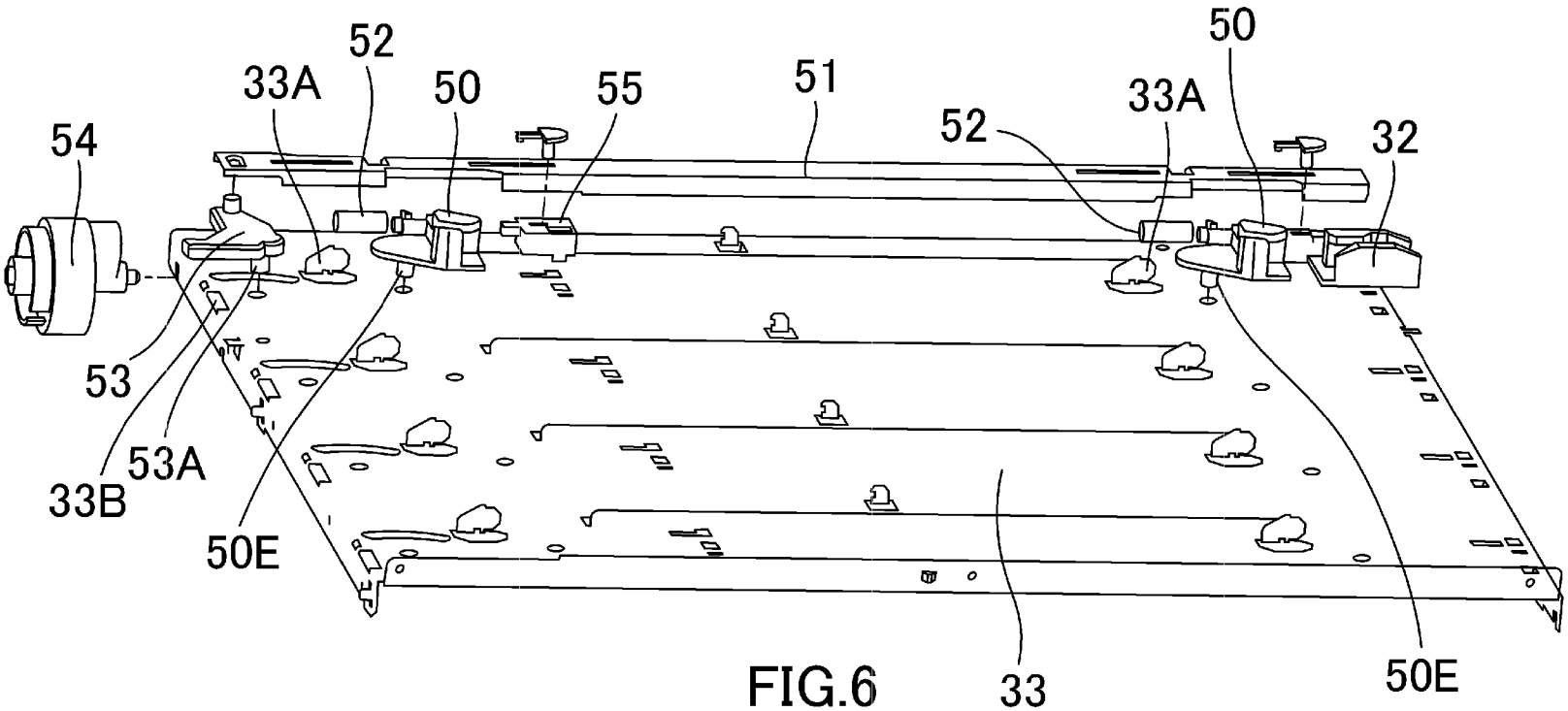
FIG. 6 is a view for describing a mechanism to cause the developing roller and a photosensitive drum to come in contact with each other and separate from each other.
Figure 7B:
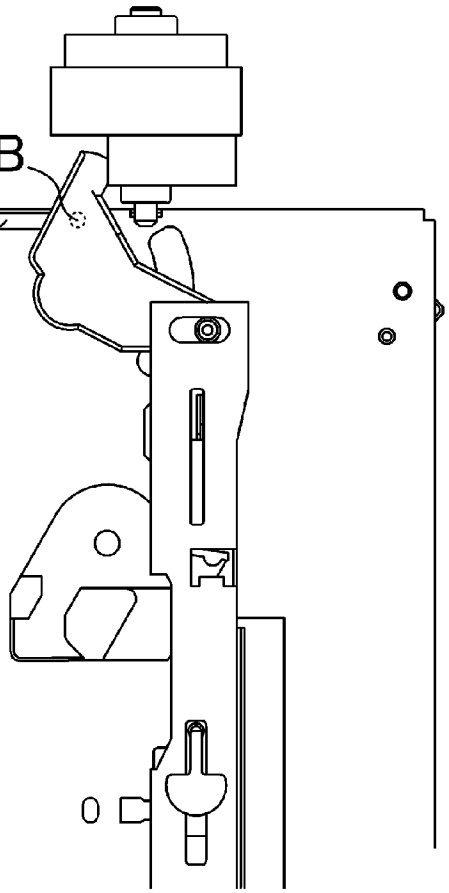
FIGS. 7A and 7B are views for describing the mechanism to cause the developing roller and the photosensitive drum to come in contact with each other and separate from each other.
Figure 7A:
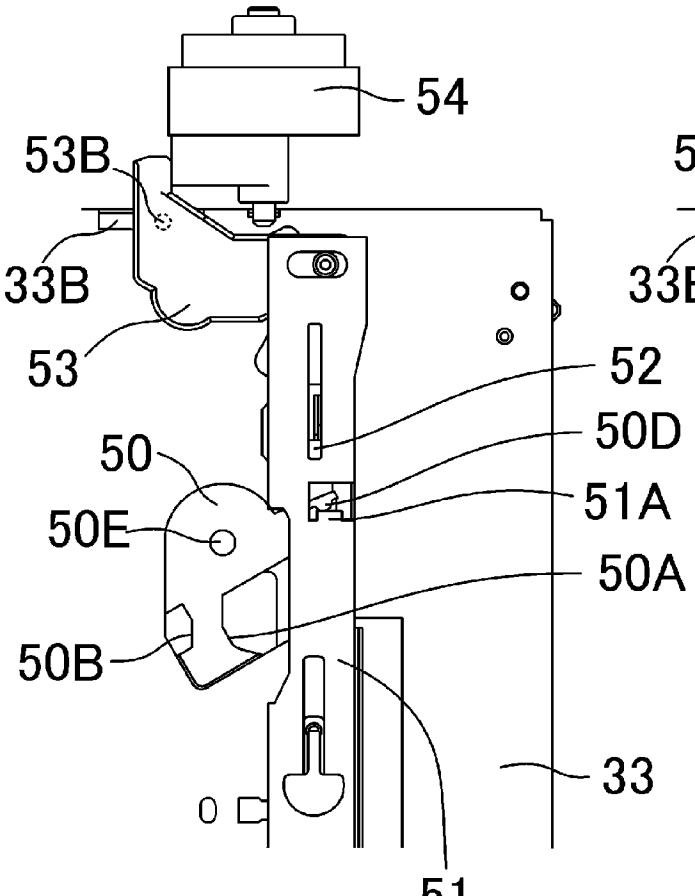
Figure 8:
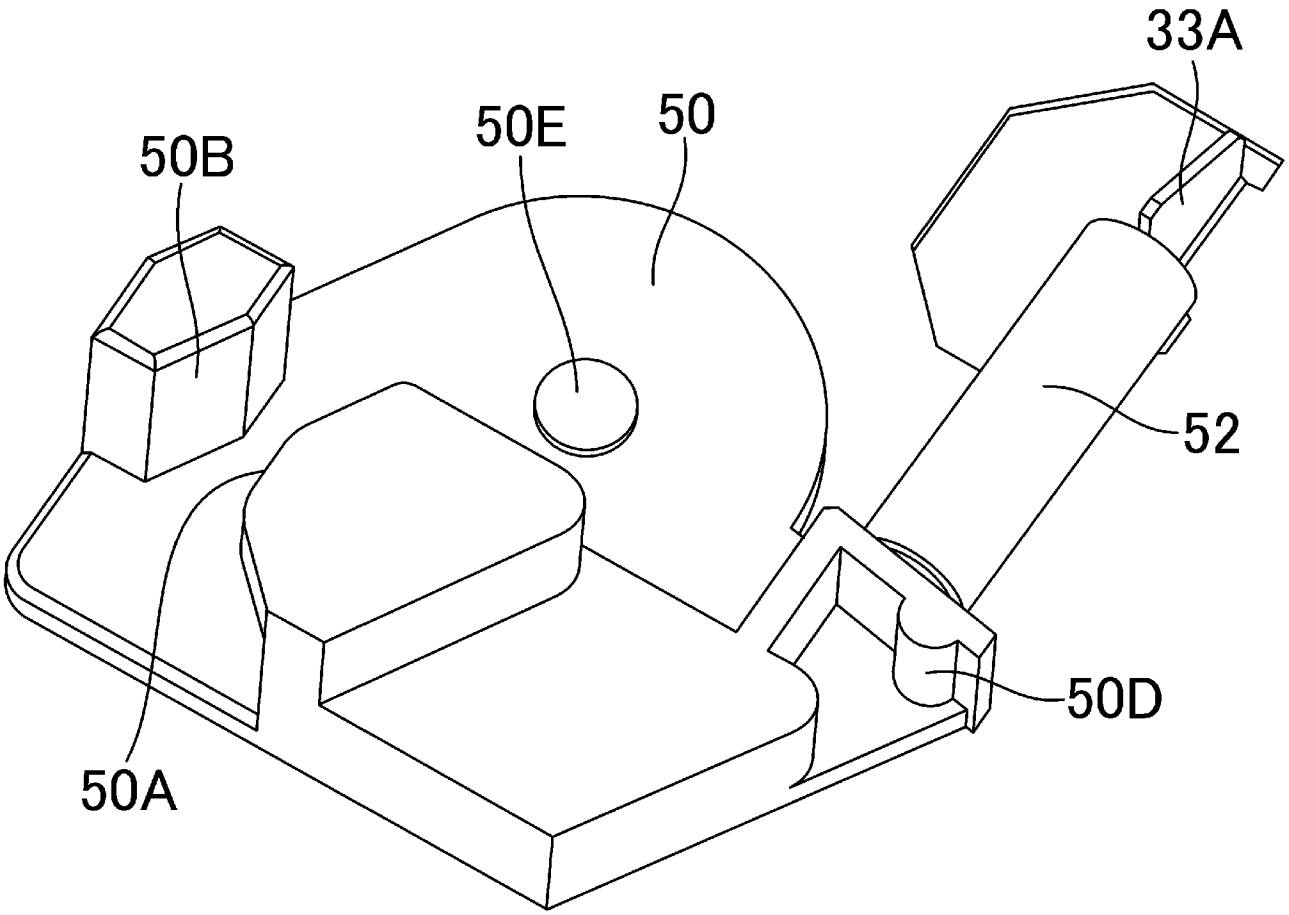
FIG. 8 is an external perspective view of a press member that presses the developing cartridge.

Next, a description will be given, with reference to FIGS. 6 to 8, of a mechanism to cause the photosensitive drum 2 and the developing roller 125 to come in contact with each other and separate from each other. FIG. 6 and FIGS. 7A and 7B are views for describing the mechanism to cause the developing roller 125 and the photosensitive drum 2 to come in contact with each other and separate from each other. FIG. 8 is an external perspective view of a press member 50 that presses the developing cartridge 104.

As shown in FIG. 6, the press members 50 are attached to a main stay 33 on both two sides in the longitudinal direction of the main stay 33. In addition, the press members 50 are attached to the main stay 33 so as to be rotatable about rotation bosses 50E. A slide member 51 is attached to the main stay 33 via a developing guide 32 and a slide bearing 55 and slidable in the longitudinal direction of the main stay 33. In addition, a separation lever 53 is a member that transmits a drive force from a separation cam 54 to the slide member 51, and attached to the main stay 33 so as to be rotatable about a rotation boss 53A. In addition, the separation lever 53 is provided with a rotation boss 53B (see FIGS. 7A and 7B), and the rotation boss 53B of the separation lever 53 is inserted in a long hole 33B extending in the width direction of the main stay 33.

A description will be given, with reference to FIG. 6 and FIGS. 7A and 7B, of the operation of the press member 50. In the embodiment, a first press surface 50A (see FIGS. 7A and 7B) of the press member 50 presses a pressed part 144A of the developing cartridge 104 due to the urging force of a developing pressure spring 52 attached to a spring seat 33A (see FIG. 6) of the main stay 33. Thus, the photosensitive drum 2 and the developing roller 125 come in contact with each other. On the other hand, when the photosensitive drum 2 and the developing roller 125 separate from each other, a second press surface 50B of the press member 50 presses the pressed part 144A of the developing cartridge 104 in a direction opposite to a direction in a case in which the photosensitive drum 2 and the developing roller 125 come in contact with each other. The operation of causing the photosensitive drum 2 and the developing roller 125 to come in contact with each other and separate from each other will be described in detail later.

(Operation of Causing Photosensitive Drum 2 and Developing Roller 125 to Come in Contact with Each Other and Separate from Each Other)

Figures 9A, 9B, 9C:
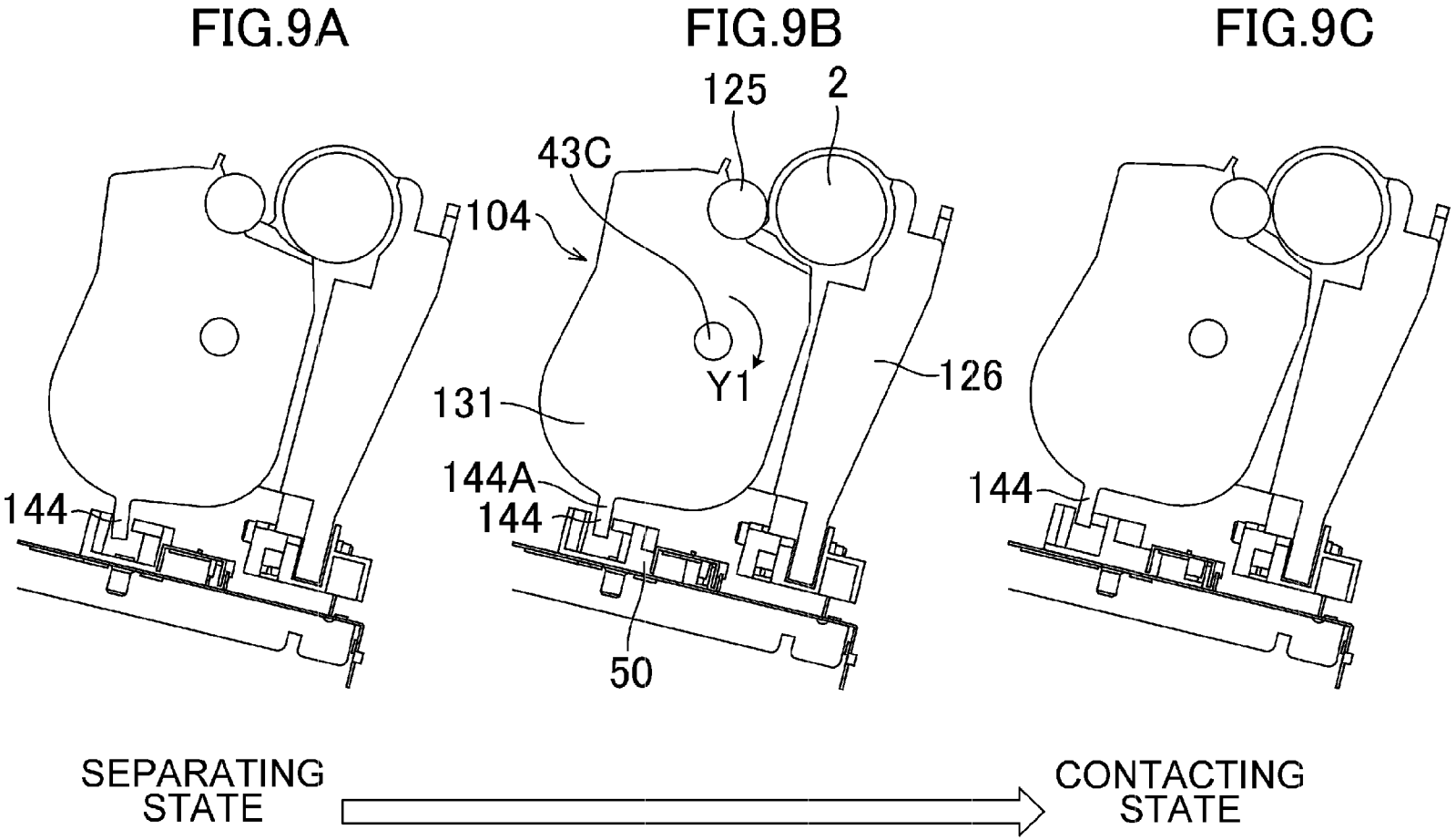
FIGS. 9A to 9C are views showing a state in which the developing roller and the photosensitive drum come in contact with each other.
Figures 10A, 10B, 10C:
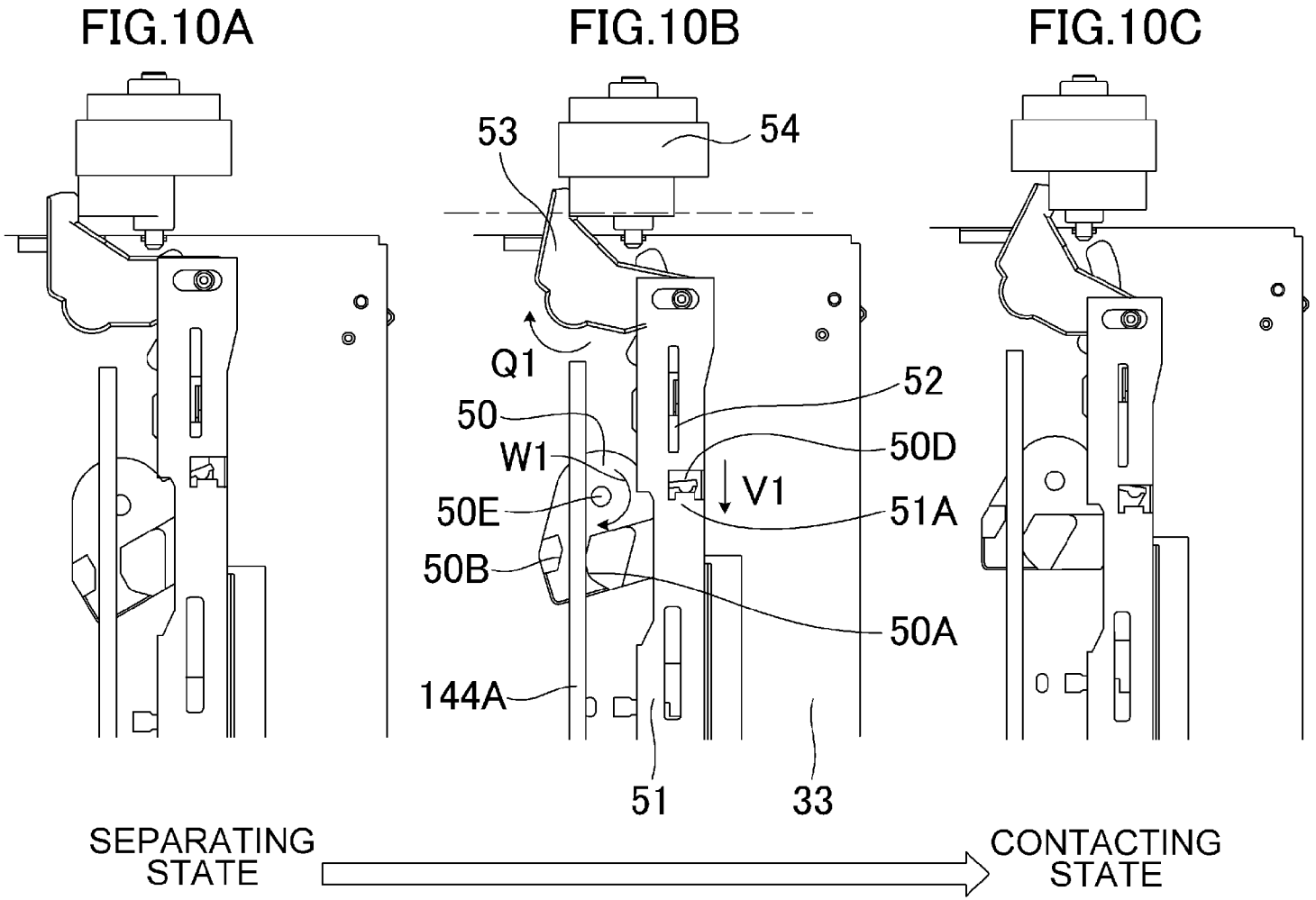
FIGS. 10A to 10C are views for describing the mechanism to cause the developing roller and the photosensitive drum to come in contact with each other and separate from each other.
Figures 11A, 11B, 11C:
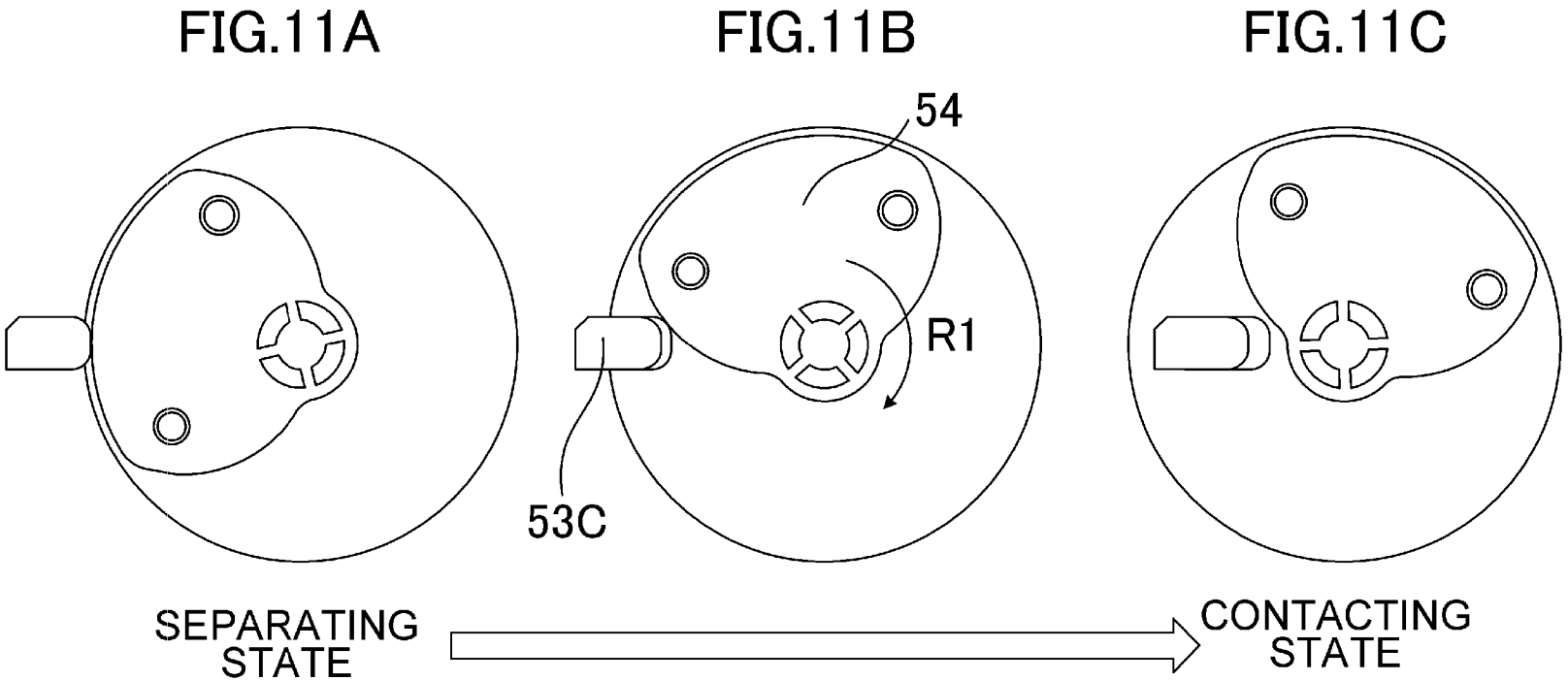
FIGS. 11A to 11C are views showing the state of a separation cam when the developing roller and the photosensitive drum are caused to come in contact with each other.
Figures 12A, 12B, 12C:
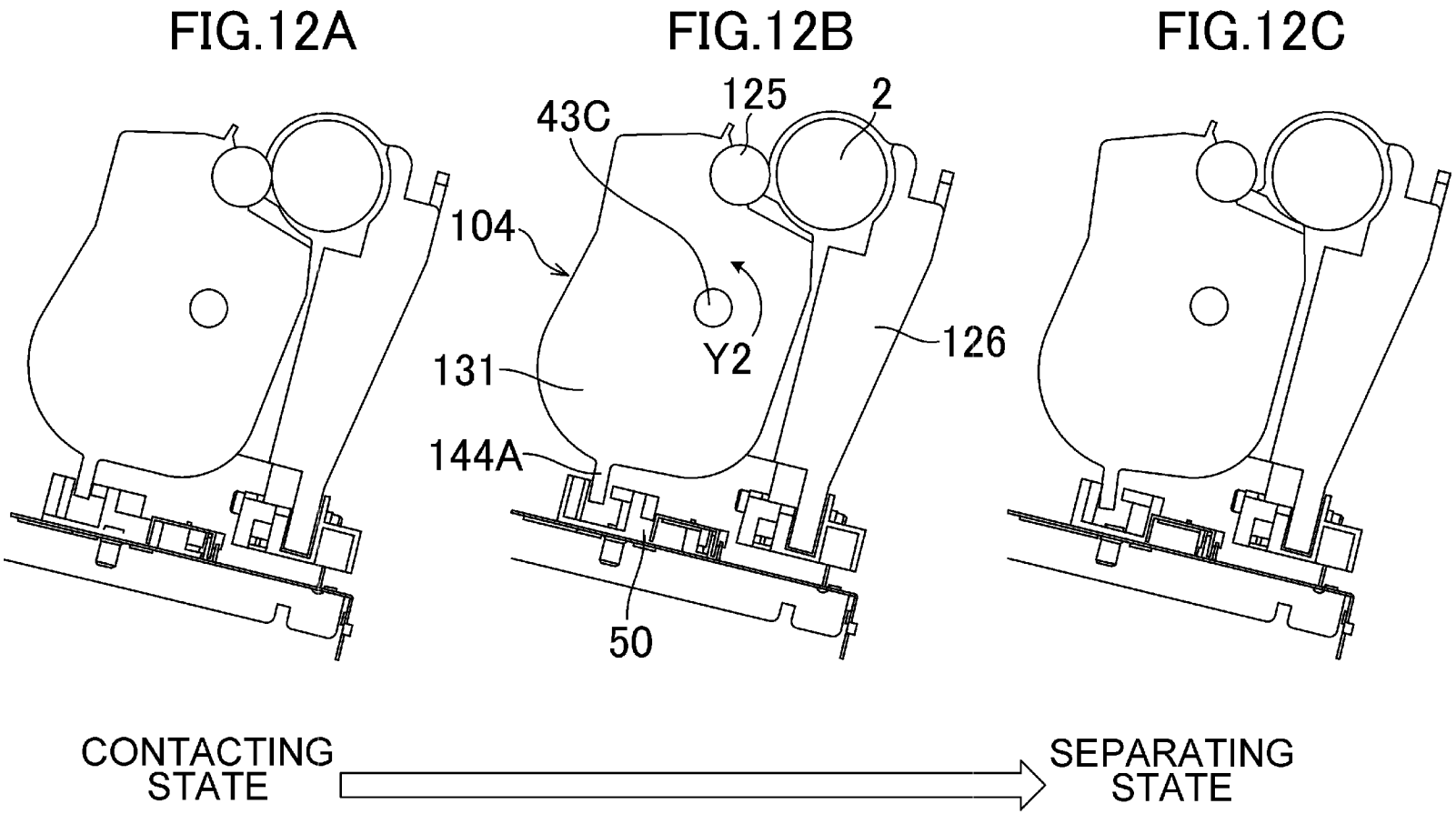
FIGS. 12A to 12C are views showing a state in which the developing roller and the photosensitive drum separate from each other.
Figures 13A, 13B, 13C:
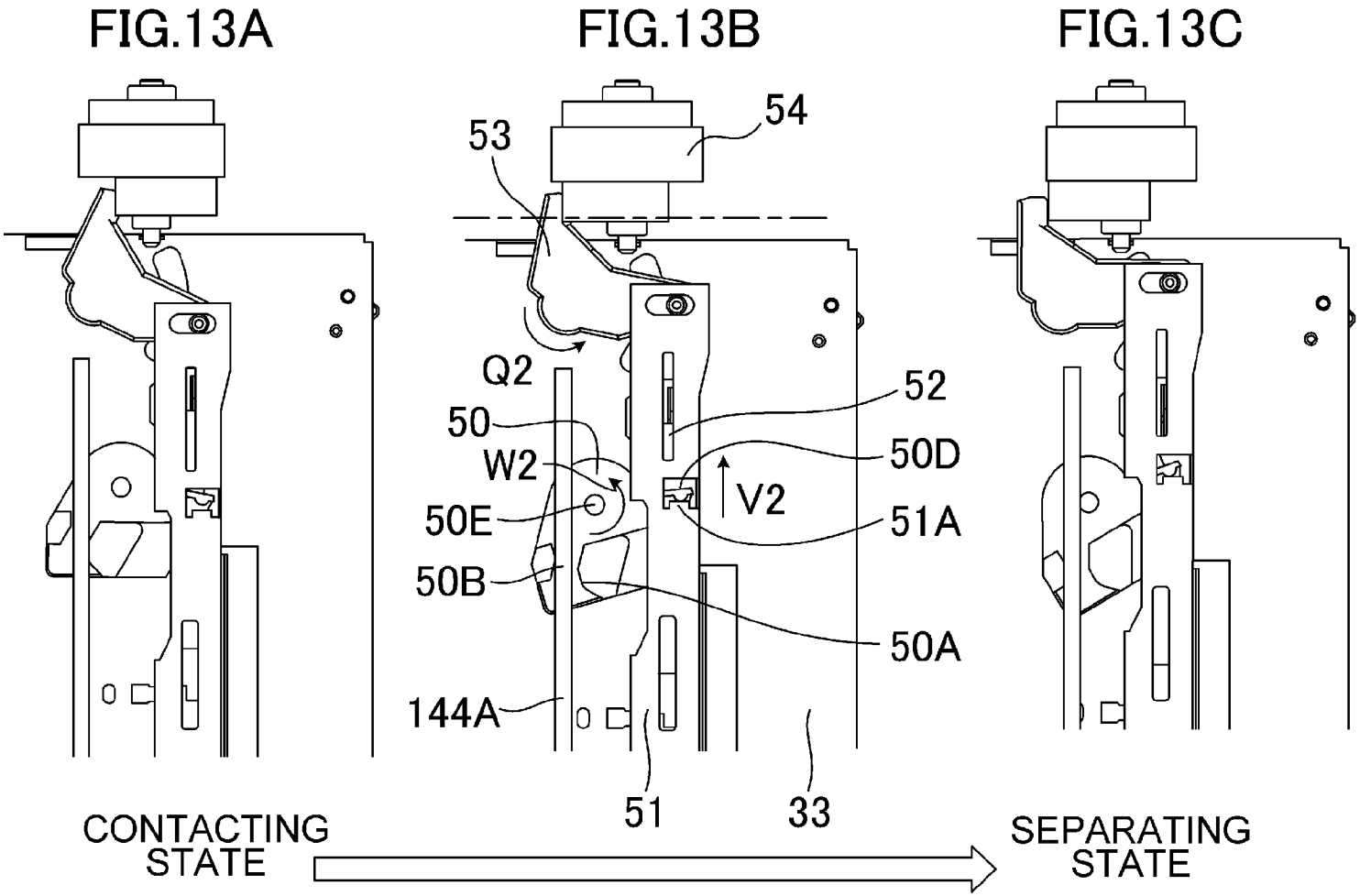
FIGS. 13A to 13C are views for describing the mechanism to cause the developing roller and the photosensitive drum to come in contact with each other and separate from each other.
Figures 14A, 14B, 14C:
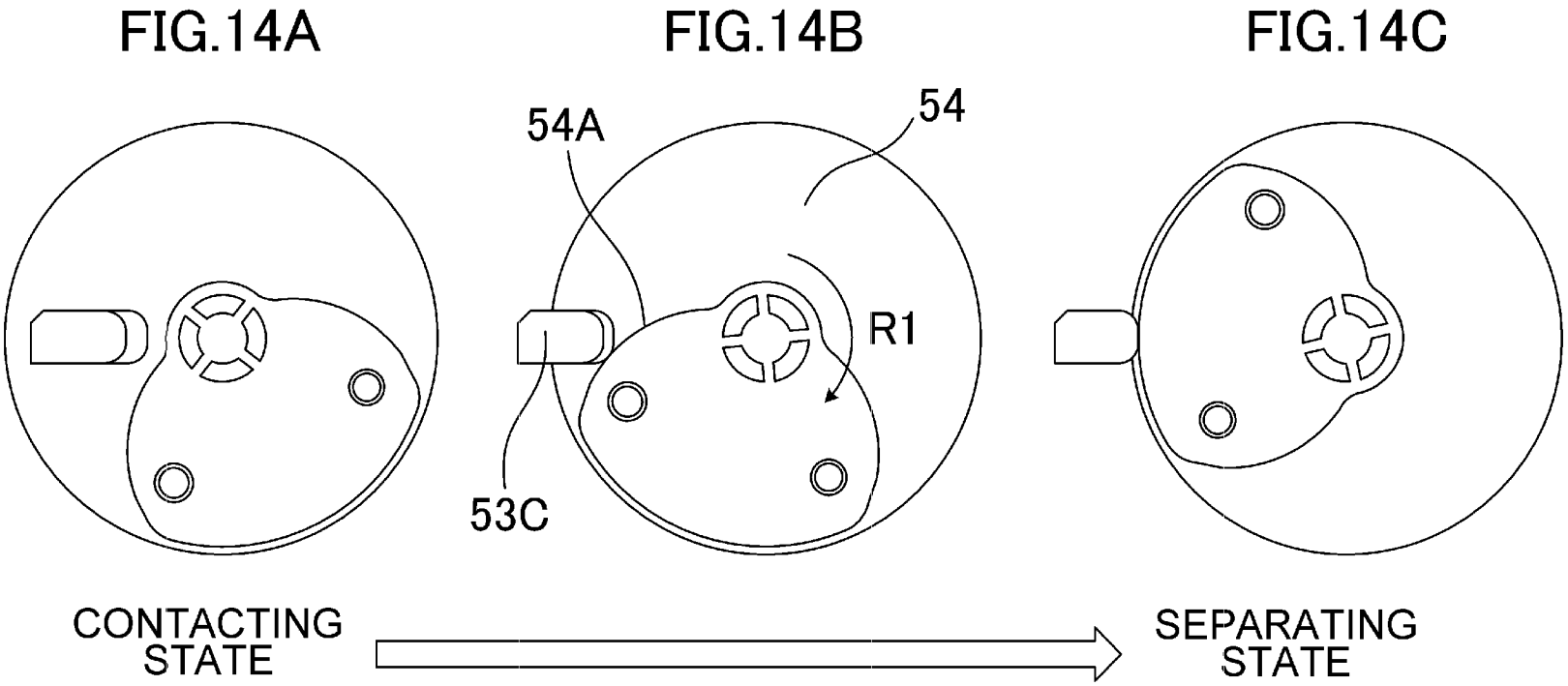
FIGS. 14A to 14C are views showing the state of the separation cam when the developing roller and the photosensitive drum are caused to separate from each other.

Next, a description will be given, with reference to FIGS. 9A to 9C to FIGS. 14A to 14C, of the operation of causing the photosensitive drum 2 and the developing roller 125 to come in contact with each other and separate from each other. FIGS. 9A to 9C are views showing a state in which the developing roller 125 and the photosensitive drum 2 come in contact with each other. FIGS. 10A to 10C are views for describing the mechanism to cause the developing roller 125 and the photosensitive drum 2 to come in contact with each other and separate from each other. FIGS. 11A to 11C are views showing the state of the separation cam 54 when the developing roller 125 and the photosensitive drum 2 are caused to come in contact with each other. FIGS. 12A to 12C are views showing a state in which the developing roller 125 and the photosensitive drum 2 separate from each other. FIGS. 13A to 13C are views for describing the mechanism to cause the developing roller 125 and the photosensitive drum 2 to come in contact with each other and separate from each other. FIGS. 14A to 14C are views showing the state of the separation cam 54 when the developing roller 125 and the photosensitive drum 2 are caused to separate from each other.

First, a description will be given, with reference to FIGS. 9A to 9C to FIGS. 11A to 11C, of the operation of causing the photosensitive drum 2 and the developing roller 125 to come in contact with each other. FIGS. 9A, 10A, and 11A show a state immediately after the developing cartridge 104 is attached to the main body of the image forming apparatus 100. In this state, the developing roller 125 and the photosensitive drum 2 are in a state of separating from each other. When a contact/separation motor (not shown) is driven in this state, the separation cam 54 starts rotating in an R1 direction indicted by an arrow as shown in FIGS. 11A to 11C. Further, as shown in FIGS. 10A to 10C, a bending part 51A of the slide member 51 is pressed toward a V1 direction by a hooking part 50D of the press member 50.

Here, the hooking part 50D of the press member 50 receives a pressure force from the developing pressure spring 52 to be urged in the V1 direction indicated by an arrow in FIG. 10B at all times. Therefore, when the separation cam 54 starts rotating in the R1 direction, an arm part 53C (see FIGS. 11A to 11C) of the separation lever 53 moves along the outer peripheral surface of the separation cam 54. As a result, the separation lever 53 rotates in a Q1 direction indicated by an arrow on the main stay 33. With the rotating operation of the separation lever 53 in the Q1 direction indicated by an arrow, the slide member 51 slides in the V1 direction indicated by an arrow. Here, as shown in FIGS. 7A and 7B, the rotation boss 53A and the rotation boss 53B of the separation lever 53 are guided by the long hole provided on the main stay 33. Thus, the separation lever 53 rotates in the Q1 direction indicated by an arrow.

When the slide member 51 slides in the V1 direction indicated by an arrow with the operation of the separation lever 53, the bending part 51A of the slide member 51 and the hooking part 50D of the press member 50 are put in a state of being not coming in contact with each other. Thus, when the hooking part 50D is pressed by the developing pressure spring 52 due to the urging force of the developing pressure spring 52 (see FIG. 8), the press member 50 starts rotating in a W1 direction indicated by an arrow on the main stay 33.

Further, when the press member 50 rotates, the first press surface 50A of the press member 50 presses the pressed part 144A of the developing cartridge 104 as shown in FIGS. 10A to 10C. Thus, as shown in FIGS. 9A to 9C, the developing cartridge 104 rotates in a Y1 direction indicated by an arrow about a rotation center 43C (see FIGS. 12A to 12C) (state shown in FIG. 9B). When the separation cam 54 further rotates in this state, the developing roller 125 and the photosensitive drum 2 come in contact with each other (state shown in FIG. 9C).

Here, in the state in which the developing roller 125 and the photosensitive drum 2 come in contact with each other, the separation cam 54 and the separation lever 53 preferably separate from each other with a certain interval therebetween as shown in FIG. 10C. In addition, in the state in which the developing roller 125 and the photosensitive drum 2 come in contact with each other, the separation cam 54 and the separation lever 53 preferably separate from each other with a certain interval therebetween as shown in FIG. 11C. Thus, it is possible to prevent the press force of the developing roller 125 from reducing with respect to the photosensitive drum 2.

Next, a description will be given, with reference to FIGS. 12A to 12C to FIGS. 14A to 14C, of the operation of causing the developing roller 125 and the photosensitive drum 2 to separate from each other. FIGS. 12A to 12C are views showing a state in which the developing roller 125 and the photosensitive drum 2 separate from each other. FIGS. 13A to 13C are views for describing the mechanism to cause the developing roller 125 and the photosensitive drum 2 to separate from each other. FIGS. 14A to 14C are views showing the state of the separation cam 54 when the developing roller 125 and the photosensitive drum 2 are caused to separate from each other.

In FIGS. 12A, 13A, and 14A, the developing roller 125 and the photosensitive drum 2 are put in a state of coming in contact with each other. When the separation motor (not shown) is driven in this state, the separation cam 54 starts rotating in the R1 direction indicted by an arrow as shown in FIGS. 14A to 14C. When the separation cam 54 starts rotating, the separation lever 53 starts rotating in a Q2 direction indicated by an arrow on the main stay 33 as shown in FIG. 13B with the arm part 53C of the separation lever 53 and an inclined surface 54A of the separation cam 54 sliding against each other.

In addition, at the same time, the slide member 51 slides in a V2 direction indicated by an arrow with the operation of the separation lever 53 when the hooking part 50D is pressed by the bending part 51A. Moreover, the press member 50 starts rotating in a W2 direction indicated by an arrow on the main stay 33 with the operation of the slide member 51. Thus, when the second press surface 50B of the press member 50 presses the pressed part 144A of the developing cartridge 104, the developing cartridge 104 rotates in a Y2 direction indicated by an arrow about the rotation center 43C (state of FIG. 12B). When the separation cam 54 further rotates in this state, the arm part 53C of the separation lever 53 comes in contact with the part of the separation cam 54 that has the smallest curvature as shown in FIGS. 14A to 14C. In the manner described above, the developing roller 125 and the photosensitive drum 2 separate from each other (state shown in FIG. 12C).

Specifically, in the embodiment, the developing roller 125 is rotatably supported by the developing frame 131 serving as a second support member in the developing cartridge 104. In addition, the developing frame 131 is rotatably supported by a support member (corresponding to a first support member) not shown. The support member not shown is positioned with respect to the main body of the image forming apparatus 100 in a state in which the developing cartridge 104 is attached to the image forming apparatus 100. Further, when the developing frame 131 is caused to rotate with respect to the support member (not shown) by the operation of the press member 50, the developing roller 125 and the photosensitive drum 2 come in contact with each other and separate from each other.

Figure 15:
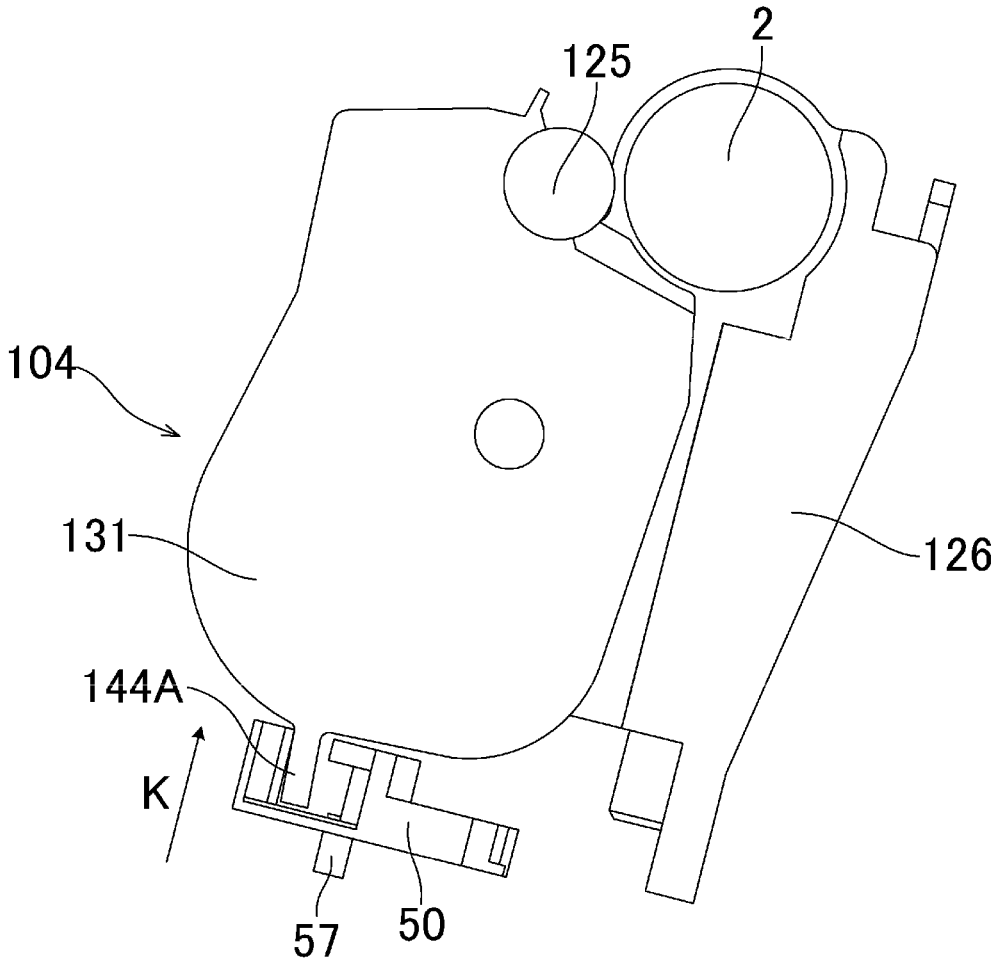
FIG. 15 is a view showing the positional relationship between the developing cartridge and the press member.

Here, FIG. 15 is a view showing the positional relationship between the developing cartridge 104 and the press member 50. In the embodiment, in order to further stabilize the contacting/separating operation between the developing roller 125 and the photosensitive drum 2, the press member 50 is urged by an urging member 57 in a direction (K direction) toward the developing frame 131 as shown in FIG. 15. When the press member 50 is urged by the urging member 57 toward the developing frame 131, the press member 50 presses the pressed part 144A of the developing frame 131 in a state in which the developing cartridge 104 is attached to the main body of the image forming apparatus 100. Note that in the embodiment, the press member 50 presses the pressed part 144A in a direction orthogonal to the direction in which the developing cartridge 104 is inserted.

Thus, the press member 50 is positioned with respect to the developing cartridge 104. Therefore, the press member 50 is allowed to constantly press the developing cartridge 104 at the same position. Since a position at which the press member 50 presses the developing cartridge 104 is hardly fluctuated, it is possible to reduce the press force of the developing roller 125 with respect to the photosensitive drum 2 and a fluctuation in the separation amount between the developing roller 125 and the photosensitive drum 2. In addition, the press member 50 is allowed to retract in a direction opposite to the direction (K direction) toward the developing frame 131 when the developing cartridge 104 is inserted in the main body of the image forming apparatus 100.

(Configuration of Pressing-Down Part 144B)

Figure 1:
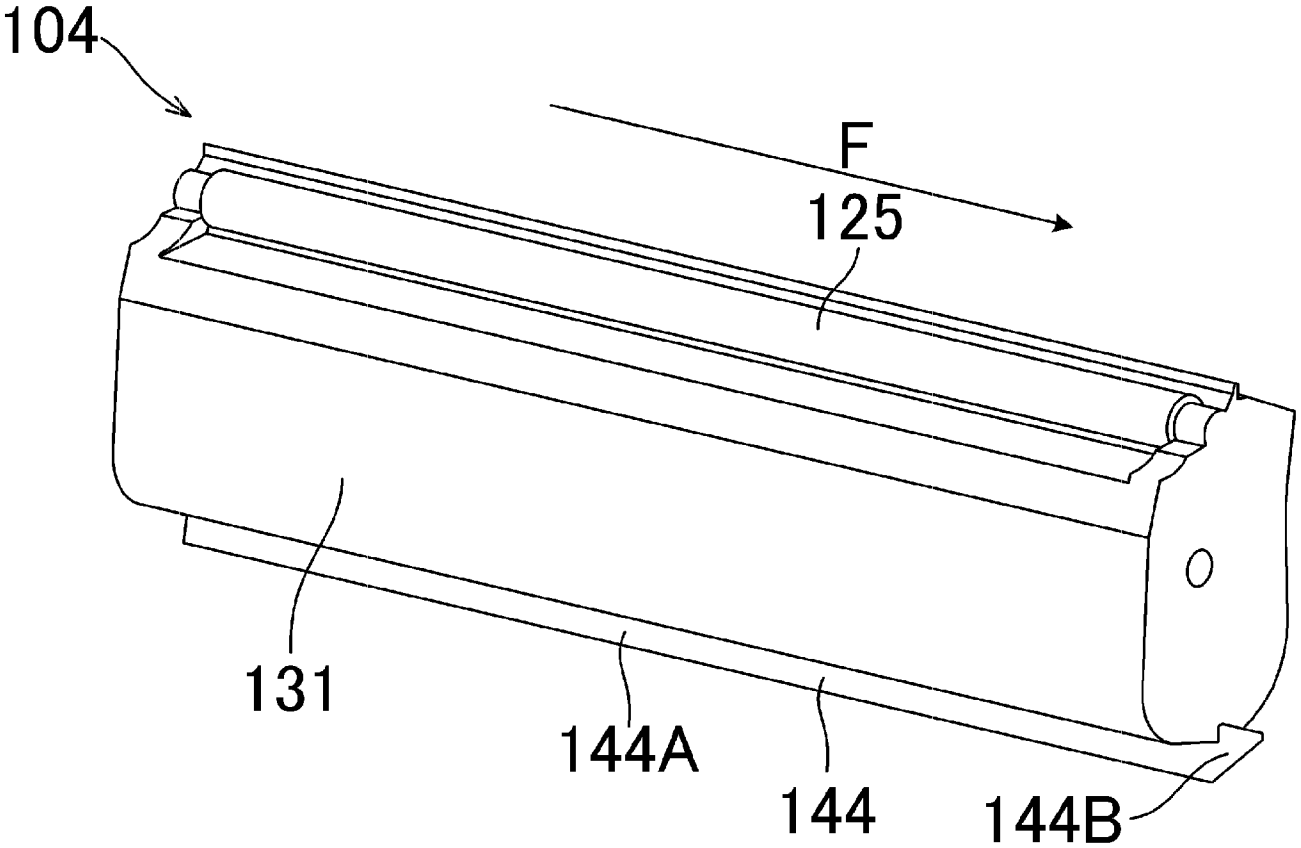
FIG. 1 is an external perspective view showing a developing cartridge according to an embodiment.
Figure 16:
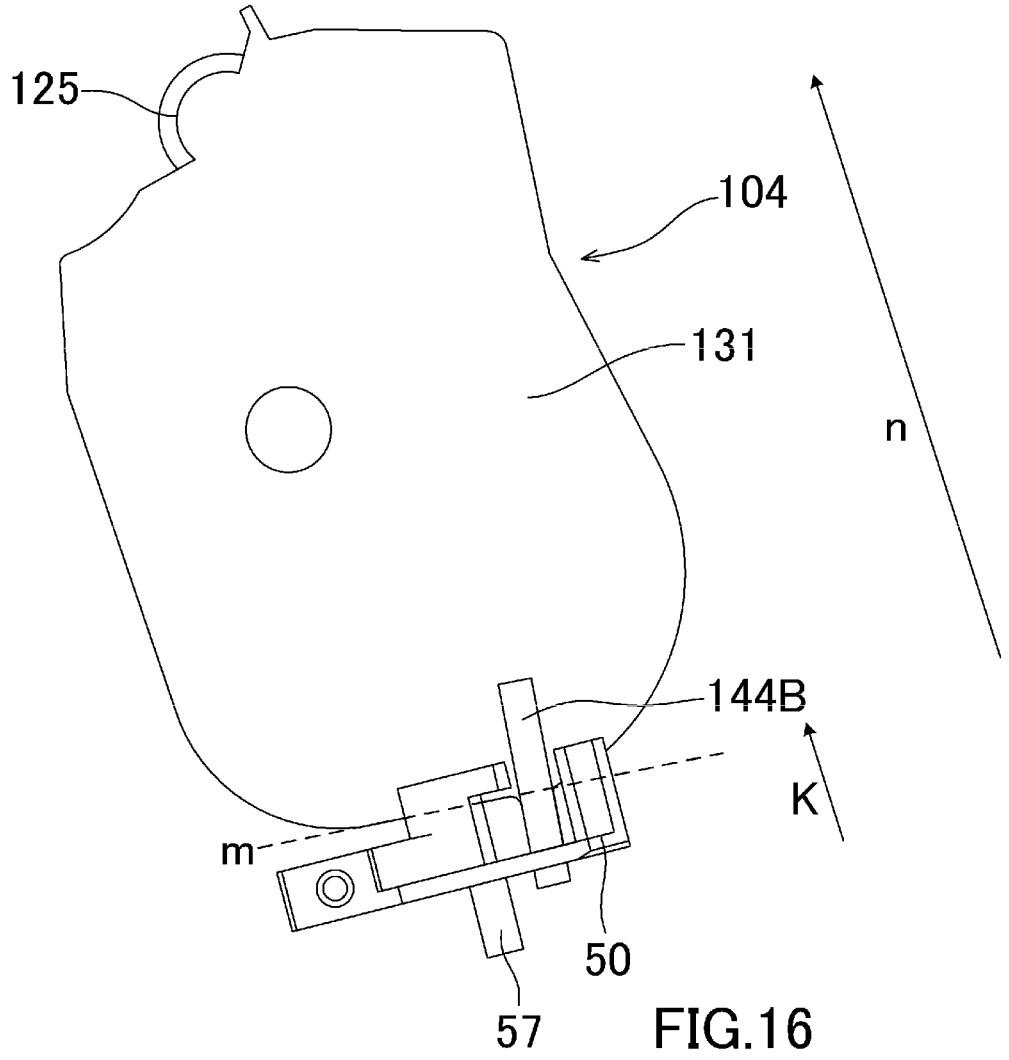
FIG. 16 is a view showing the positional relationship between the developing cartridge and the press member.

Next, a description will be given, with reference to FIGS. 1 and 16, of the configuration of a pressing-down part 144B serving as a guiding part in the developing cartridge 104 according to the embodiment. FIG. 16 is a view showing the positional relationship between the developing cartridge 104 and the press member 50. A rib 144 is provided so as to extend toward the direction (F direction) in which the developing cartridge 104 is inserted, and is a part protruding downward from the developing frame 131 of the developing cartridge 104 in a posture in which the developing cartridge 104 is attached to the image forming apparatus 100. The rib 144 is provided with the pressed part 144A and the pressing-down part 144B. In addition, the pressed part 144A is a surface extending toward the direction (F direction), in which the developing cartridge 104 is inserted, in the posture in which the developing cartridge 104 is attached to the image forming apparatus 100. In addition, the pressing-down part 144B serving as a guiding part is positioned at an end on the downstream side in the direction (F direction), in which the developing cartridge 104 is inserted, at the rib 144 of the developing cartridge 104. In addition, the pressing-down part 144B is an inclined surface provided on the downstream side in the direction (F direction) in which the developing cartridge 104 is inserted. In addition, the pressing-down part 144B is inclined with respect to the direction in which the developing cartridge 104 is inserted, and inclined with respect to a direction in which the press member 50 presses the pressed part 144A.

Here, as described above, the press member 50 is urged in the K direction by the urging member 57. Therefore, in a state in which the developing cartridge 104 is removed from the image forming apparatus 100, the press member 50 overlaps with a region in which the developing cartridge 104 is inserted when seen from the downstream side in the direction in which the developing cartridge 104 is inserted. At a timing at which the insertion of the developing cartridge 104 in the image forming apparatus 100 starts, the developing frame 131 of the developing cartridge 104 and the press member 50 overlap with each other when seen from the downstream side in the direction in which the developing cartridge 104 is inserted.

That is, as is also clear from a dashed-line part m, the press member 50 overlaps with the developing frame 131 of the developing cartridge 104. In the embodiment, when a front door (not shown) is closed in the state in which the developing cartridge 104 is attached to the main body of the image forming apparatus 100, the developing cartridge 104 moves in an n direction in FIG. 16 with the operation of closing the front door (not shown). Therefore, in order to correspond to the movement of the developing cartridge 104 in the n direction, the press member 50 overlaps with the developing frame 131 of the developing cartridge 104. Thus, at the timing at which the insertion of the developing cartridge 104 in the image forming apparatus 100 starts, the position of the pressing-down part 144B is higher than the position of the press member 50 in a vertical direction.

Figure 17A:
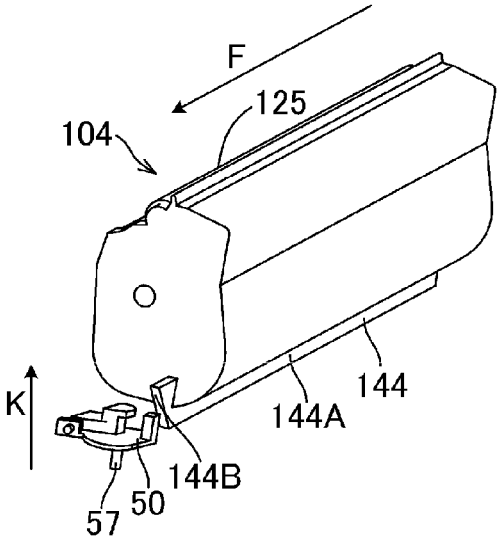
FIGS. 17A to 17D are views showing a state in which a pressing-down part presses down the press member.

Next, a description will be given, with reference to FIGS. 17A to 17D, of the operation of pressing down the press member 50 with the pressing-down part 144B when the developing cartridge 104 is inserted in the image forming apparatus 100. FIGS. 17A to 17D are views showing a state in which the pressing-down part 144B presses down the press member 50. As shown in FIG. 17A, immediately before the developing cartridge 104 is inserted in the image forming apparatus 100, the press member 50 and the developing cartridge 104 overlap with each other when seen in the direction (F direction) in which the developing cartridge 104 is inserted.

Figure 17B:
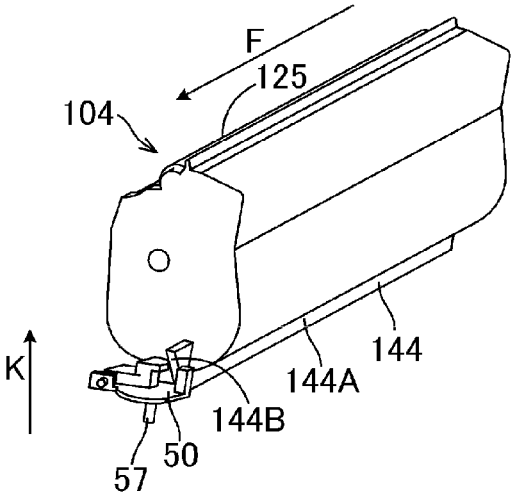
Figure 17C:
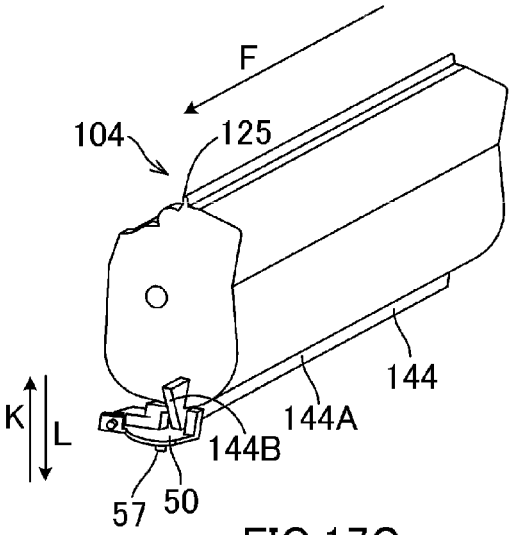
Figure 17D:
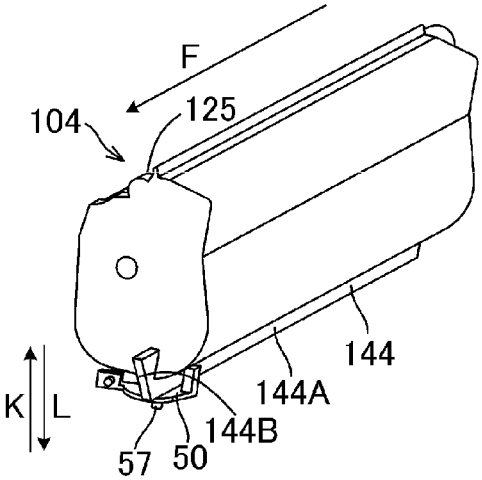

When the insertion of the developing cartridge 104 in the image forming apparatus 100 starts, the pressing-down part 144B of the rib 144 provided on the developing frame 131 and the press member 50 contact each other as shown in FIG. 17B. Further, when the developing cartridge 104 is further inserted, the press member 50 is pressed down by the pressing-down part 144B toward the L direction opposite to the direction (K direction) in which the urging member 57 urges the press member 50 as shown in FIG. 17C. After that, in a state in which the developing cartridge 104 is completely attached, the press member 50 is urged in the K direction by the urging force of the urging member 57 as shown in FIG. 17D. Therefore, the press member 50 is allowed to press a part near the root of the rib 144 of the pressed part 144A of the developing cartridge 104. Thus, in the state in which the developing cartridge 104 is attached to the main body of the image forming apparatus 100, the press member 50 is positioned with respect to the developing cartridge 104. Therefore, the press member 50 is allowed to constantly press the developing cartridge 104 at the same position. Thus, it becomes possible to insert the developing cartridge 104 without impairing usability even in a state in which the press member 50 and the developing cartridge 104 overlap with each other when seen in the direction (F direction) in which the developing cartridge 104 is inserted.

As described above, in the embodiment, the pressing-down part 144B serving as a guiding part presses the press member 50 in the direction opposite to the direction in which the urging member 57 urges the press member 50 with the operation of inserting the developing cartridge 104 in the main body of the image forming apparatus 100. Further, the press member 50 moves to a prescribed position. Thus, it becomes possible to easily attach the developing cartridge 104 to the main body of the image forming apparatus 100 while positioning the press member 50 with respect to the developing cartridge 104.

Note that the pressing-down part 144B serving as a guiding part is provided on the developing cartridge 104 in the embodiment but may be provided on other parts. For example, since the drum cartridge 126 is rotatable by the press member 50, the pressing-down part 144B may be provided on the drum cartridge 126.

In addition, the pressing-down part 144B presses down the press member 50 in the embodiment but may be configured in other ways. For example, the pressing-down part 144B may be configured to press up the press member 50.

In addition, in the embodiment, the rib 144 protrudes downward from the developing frame 131 of the developing cartridge 104 in the posture in which the developing cartridge 104 is attached. In addition, the rib 144 extends toward the direction in which the developing cartridge 104 is inserted in the posture in which the developing cartridge 104 is attached. However, the rib 144 may have other shape. The shape or the like of the rib 144 is not particularly limited so long as it is allowed to move the pressing-down part 144B.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-48678, filed on Mar. 11, 2016, which is hereby incorporated by reference herein in its entirety.

What is claimed is:

1. A developing cartridge attachable/detachable to/from a main body of an image forming apparatus, the developing cartridge comprising:

a developer bearing member that bears developer to form a developer image on an image bearing member provided in the main body of the apparatus;

a developing frame that supports the developer bearing member; and a pressed part that is provided on the developing frame, wherein, in a state in which the developing cartridge is attached to the main body of the apparatus, the developing frame moves when the pressed part is pressed by a press member, provided in the main body of the apparatus, to move the developer bearing member, wherein the pressed part is provided with a positioning part that contacts and positions the press member, and the press member is urged toward the positioning part by an urging member, and wherein the developing frame has a guiding part that moves the press member against an urging force of the urging member when the developing cartridge is attached to the main body of the apparatus.

2. The developing cartridge according to claim 1, wherein the guiding part is a surface that (i) is inclined with respect to a direction, in which the developing cartridge is inserted in the main body of the apparatus when the developing cartridge is attached to the main body of the apparatus and (ii) is inclined with respect to a direction in which the press member presses the pressed part, and the guiding part presses and moves the press member as the developing cartridge is inserted in the main body of the apparatus.

3. The developing cartridge according to claim 1, wherein the pressed part (i) extends in a direction in which the developing cartridge is inserted in the main body of the apparatus when the developing cartridge is attached to the main body of the apparatus and (ii) protrudes in a direction opposite to a direction in which the press member presses the pressed part.

4. The developing cartridge according to claim 3, further comprising:

a support member that rotatably supports the developing frame, wherein the support member is positioned with respect to the main body of the apparatus in the state in which the developing cartridge is attached to the main body of the apparatus, and the developing frame rotates with respect to the support member when being pressed by the press member.

5. The developing cartridge according to claim 4, wherein the developing frame rotates when the pressed part is pressed by the press member in a direction different from a direction in which the urging member urges the press member.

6. The developing cartridge according to claim 1, wherein the developing frame rotates about a rotation center axis extending in a direction substantially parallel to a direction in which the developing cartridge is inserted in the main body of the apparatus.

7. The developing cartridge according to claim 1, wherein the developing frame has a rib extending in a direction in which the developing cartridge is inserted in the main body of the apparatus, and the pressed part and the guiding part are provided on the rib, and the guiding part is provided at a downstream side end of the rib in the direction in which the developing cartridge is inserted in the main body of the apparatus.

8. The developing cartridge according to claim 1, wherein the developer bearing member is a developing roller and is attached/detached in a direction substantially parallel to a rotation center axis direction of the developer bearing member.

9. The developing cartridge according to claim 1, wherein the press member is positioned with respect to the developing cartridge in a state in which the developing cartridge is attached to the main body of the apparatus.

10. The developing cartridge according to claim 9, wherein the press member is positioned with respect to the developing cartridge when pressing the pressed part in a direction orthogonal to a direction in which the developing cartridge is inserted to the main body of the apparatus.

11. The developing cartridge according to claim 1 wherein, the urging member is provided in the main body of the apparatus.

* * * * *